United States Patent [19]

Giros

[11] 3,965,711

[45] June 29, 1976

[54] DEVICES FOR CONTINUOUSLY DISPLACING A FILAMENTARY MATERIAL IN A TREATMENT INSTALLATION

[75] Inventor: Marcel A. Giros, Ancerville, France

[73] Assignee: Societe Meusienne de Constructions Mecaniques, Ancerville (Meuse), France

[22] Filed: Jan. 8, 1975

[21] Appl. No.: 539,496

[30] Foreign Application Priority Data

Feb. 23, 1973 France ..... 73.07418

[52] U.S. Cl. ..... 72/39; 72/135; 140/1

[51] Int. Cl.[2] ..... B21F 21/00; B21F 3/02

[58] Field of Search ..... 72/39, 135; 134/14, 134/159; 140/1, 2

[56] References Cited

UNITED STATES PATENTS

| | | | |
|---|---|---|---|
| 2,651,104 | 9/1953 | Giros | 72/39 |
| 3,002,537 | 10/1961 | Kenmore et al. | 140/1 |
| 3,348,394 | 10/1967 | Giros | 72/39 |
| 3,399,702 | 9/1968 | Kenmore | 72/39 |
| 3,501,347 | 3/1970 | Kenmore | 134/14 |

*Primary Examiner*—C.W. Lanham
*Assistant Examiner*—E. M. Combs
*Attorney, Agent, or Firm*—Otto John Munz

[57] ABSTRACT

The invention relates to a device for the continuous treatment of a semi-worked filamentary of strand-like metal material of indefinite length, arranged helically, of which the turns, supported and driven by rotating horizontal shafts, are immersed in a treating agent.

An apparatus of this kind comprises two capstans or winches fitted with idle satellites or rollers; two strands of material coming from delivery units are bent thereon and assume the shape of two helices supported and driven respectively by pairs of horizontal shafts, and immersed in a treatment agent contained in a tank. The two helices rotate in opposite directions their turns interpenetrating, so that they guide each other; the size of each turn is regulated at the same time, if it increases, by its possible contact with one of the shafts bearing the other helix, and by the distance, adjustable during operation, between the two shafts of the pair bearing it.

The system can be applied to all surface treatments, such as pickling, coating or deposition, carried out on filamentary or strand-like metal materials, particularly in wire-drawing.

10 Claims, 12 Drawing Figures

Fig.1
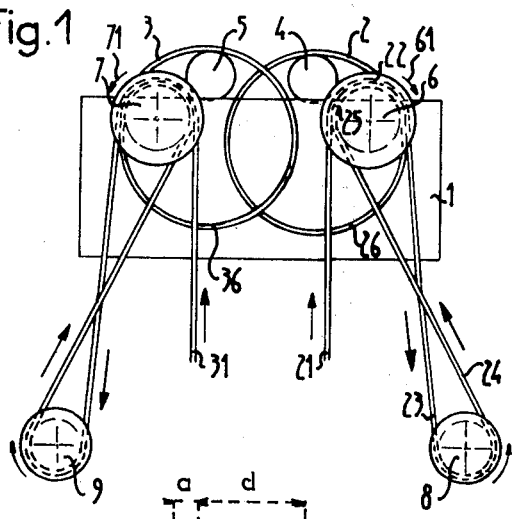
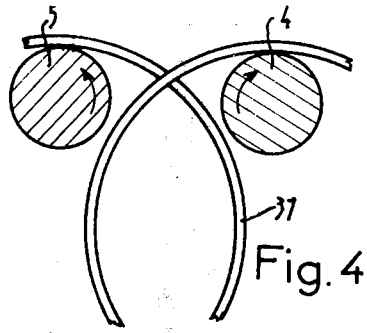
Fig. 4
Fig. 2
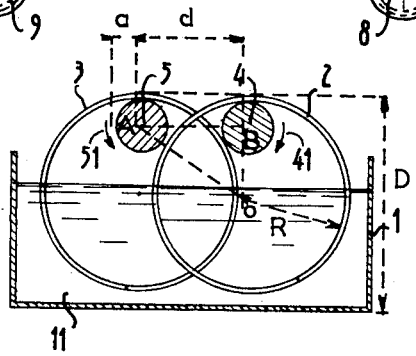
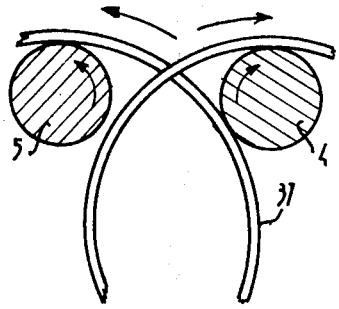
Fig. 5
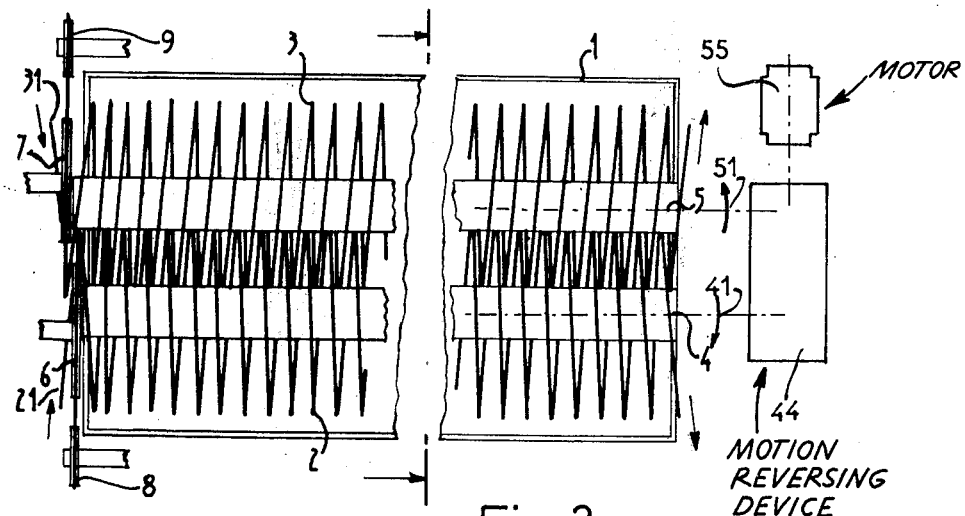
Fig. 3

DEVICES FOR CONTINUOUSLY DISPLACING A FILAMENTARY MATERIAL IN A TREATMENT INSTALLATION

CROSS-REFERENCES TO RELATED APPLICATIONS

United States Patents Nos:

| | | | |
|---|---|---|---|
| 2,651,104 | 9-1953 | GIROS | 72-39 |
| 3,348,394 | 10-1967 | GIROS | 72-39 |

BACKGROUND OF THE INVENTION

Field of the Invention

Flexible wire elements of solid material such as a metal as supplied in metallurgy have to be scoured or pickled before use in industry and the main object of the invention is to provide a means to treat such material by the formation of a pair of helices bathed or immersed in a treating tank or chamber and supported by one or more shafts which are driven in rotation.

Description of the Prior Art

It is known for the continuous treatment of metal strips or wires to use a device, causing them to pass through a chamber or treatment bath, in successive turns forming a helix supported by one or more horizontal driving shafts.

In my U.S. Pat. No. 3,348,394 I have disclosed an apparatus for continuously displacing a filamentary material in a treatment installation by which two helices of this kind placed side by side and partly interpenetrating, are caused to pass through one and the same chamber or treatment bath; in a device of this kind the partial interpenetration and same direction of rotation of two helices causes them to be automatically guided and their size to be automatically regulated; furthermore, each helix is supported by two shafts which are themselves supported and driven in rotation in the same direction and at the same speed. In a device according to the said patent, the operation of regulating the size of the turns of the helices is preferably improved by the provision of an additional non-driven shaft positioned in the cavity formed or defined by the external surfaces of the two helices on the boundary of their interpenetration zone; this shaft rotates in the opposite direction to the two helices, which necessarily rotate in one direction.

SUMMARY OF THE INVENTION

The present invention provides improvements in the aforementioned device; it is based on the one hand on the observation that the automatic guiding effect is obtained by causing the two helices to rotate in opposite directions in order to ensure that the upper parts of the turns of one helix move away from those of the turns of the other helix, i.e. the right helix rotates clockwise and the left helix rotates anticlockwise, and also on the observation that additional use can be made of one of the shafts driving one of the helices in order to regulate the size of the turns of the other helix: in other words, the said shaft serves two purposes, i.e. that of supporting and driving one of the helices and that of assisting the control of the turns of the other.

As regards the automatic guiding effect, the necessity of ensuring that each helix rotates in a suitable direction for this purpose has been demonstrated by an experiment in which hoops instead of turns of a helix were arranged around the motor shafts, the hoops of one shaft intercalating with those of the other. It was found that if the shafts rotated in opposite directions and their direction of rotation was such that the upper parts (or more precisely, the material of which they consisted) of the hoops of one shaft moved away from those of the hoops of the other, the hoops remained in substantially parallel planes, suitably intercalated, whereas if the direction in which the shafts rotated was such that the upper parts of the hoops approached one another the hoops of one and the same shaft rapidly overlapped, intercalating themselves at random between those of the other.

As regards the automatic regulation, it takes place as follows: there is always a slight slip between a helix and its driving shaft or shafts; if, when the turns are of normal size, one of the shafts supporting a helix is at a comparatively short distance from the other helix, but without touching it, and if a turn of the helix becomes too large, it makes contact with the shaft of the other helix; under these conditions the turning force exerted upon that particular portion of the helix, and consequently its linear speed, is increased due to the fact that it is being driven not only by contact with its own shaft but in addition by its contact with the shaft rotating the other helix, as is clear from inspection of FIG. 5 and considering the opposite directions of rotation of the two shafts as shown. It is noted from the figure that it is the upper or upstream portion of the turn or loop that is there being driven by contact with both shafts.

In this way the linear speed of the loop or portion of the helix in question is augmented or increased with the result that the excessive size or diametral dimension thereof is diminished. It will be noted also that if it were the downstream portion of the loop contacted by the other shaft and its speed increased no automatic regulation would take place.

Thus it is clear that for automatic control of loop size in accordance with the invention, the point of contact between the helix loop of excessive diameter and the driving shaft of the other helix, must be "upstream" with respect to the point of contact of the loop and its own driving shaft.

Furthermore in order that the automatic regulation takes place, the contact of a helix with the shaft supporting the other helix must occur before that turn is too large and touches the bottom of the treatment tank. This requires that the distance between the axes of the shafts be smaller than the square root of twice the product of the radius of said shafts into the distance from the bottom of the tank to the top of said shafts. In other words, if:

"$d$" is the distance between the axises of the shafts

"$a$" is the radius of the shafts

"$D$" is the distance of the bottom of the tank to the top of the shafts it is necessary for the automatic regulation to take place that $$d < \sqrt{2.a.D.}$$

as will be explained later in a simple calculation appearing in connection with the description of the drawings.

The above formula gives a superior limit to the distance between the axises of the shafts. On the other hand this distance cannot be too small lest the contact should be permanent between a turn of a helix and the shaft supporting the other helix. Experience has shown that the lower limit to "*d*" is approximately seven tenths of the upper or greater limit. It is therefore a characteristic of the invention that "*d*" should be $$\sqrt{a.D} < d < \sqrt{2.a.D.}$$

taking into account that $1/\sqrt{2}$ is roughly 0.7.

In this case, therefore, the regulation takes place without the necessity of introducing a non-driven supplementary shaft as it was the case in my U.S. Pat. No. 3,348,394. In a device according to the present invention, to enable the regulating action to take effect for both helices, the shafts must be caused to turn in opposite directions. This is obtained by the two shafts being driven by two separate motors, or by one shaft being directly driven by a motor and the other shaft being driven by a motion-reversing device, which is known per se, adapted to that motor.

In the aforementioned patent, a preferred shaping process for the production of two helices from two strands of wire consists of the use of one single capstan onto which the two strands wind themselves continuously and in alternation and on which they slip to the extent of escaping contact; the use of one single capstan, although convenient, means that the two helices necessarily rotate in the same direction, so that a system of this kind cannot be used in an apparatus according to the invention. Neither can conventional apparatus with rollers be considered as a means of shaping the two helices rotating in opposite directions, because owing to the rotation of the helices in opposite directions the two devices with rollers would encroach upon each other.

Means are known for the shaping of helices, consisting of the use of a V-grooved capstan or winch and a satellite or roller; the entering wire is wound on the winch in the groove over about half a circumference, then leaves it for the idle roller, returning to the winch underneath the entering strand and emerging from it in the form of a helix after a further traject of about half a circumference. Experience shows that the turns of the helix thus formed are larger than the diameter of the winch by which they have been shaped; the increase is of the order of 100 %, if the outgoing and returning strands of the roller are crossed. It follows that if use is made of two capstans of this kind, placed side by side, the helices formed by them will interpenetrate to the extent of about 50 %; means are provided to rotate the capstans in opposite directions, and it is thus possible to form two helices rotating in opposite directions and interpenetrating by 30 %, for example, which is suitable for a device according to the invention.

At this point it is worth mentioning that it would be impossible to use such a device consisting of two capstans and two rollers for the formation of two helices subjected to interpenetrating and to rotating in the same direction, since with two capstans rotating in the same direction the helices thus formed would not interpenetrate, and with two capstans rotating in opposite directions the helices thus formed would not rotate in the same direction. It follows that capstans and rollers may not be provided for the formation of helices on the apparatus of my U.S. Pat. No. 3,348,394.

According to the present invention each helix can be supported and driven by one single shaft; in this case there are two shafts rotating in opposite directions, each shaft performing two functions: to support and guide one helix and regulate the other.

A preferred means for supporting the helices and regulating the size of their turns is as follows:

Instead of supporting and driving each helix by one single shaft, the two helices are each supported by two shafts known as main shaft and secondary shaft. In this case the secondary shafts are given a smaller diameter than the main shafts, in order to make it possible to accomodate the said secondary shafts inside the turns of the helices during their way outside the treatment bath and also to position the main shaft and the secondary shaft of a helix on the two sides of a median longitudinal vertical plane of a treatment bath, i.e. to cross the secondary shafts of the two helices; it obviously follows that the secondary shaft situated on the left of this plane supports the right-hand helix, and vice versa, and also that the two secondary shafts are situated inside each of the helices, in the part in which they interpenetrate. Furthermore by using shifting means in combination with the secondary shafts to adjust, as desired and within certain limits, the distance of said shafts to said plane during operation for each of the shafts separately, this arrangement provides a further means of governing the size of the turns of the helix, regulating their size to a greater or smaller extent by the effect of their temporary contact with the main shaft of the other helix.

BRIEF DESCRIPTION OF THE DRAWINGS

FIG. 1 is an end view of a device in accordance with a first embodiment of the invention, with two helices, each of which is supported by a respective one of two shafts.

FIG. 2 is a sectional diagram of the same.

FIG. 3 is a plan view of the same.

FIG. 4 and FIG. 5 are detail views to an enlarged scale showing how the size of the turns is regulated.

DESCRIPTION OF THE PREFERRED EMBODIMENT

First, with reference to FIGS. 10 and 11, an explanation will be given of experimental results relating to the automatic guiding phenomenon. In these diagrams of shaft 100 supports two hoops 101 and 102 engaging between comb teeth 103.

Figure 10:
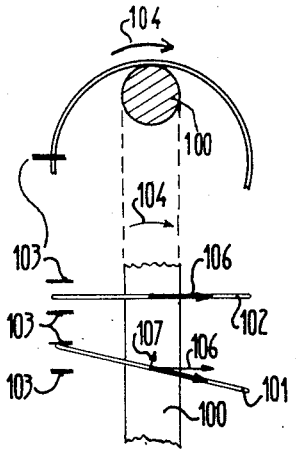
FIG. 10 is a combination of a plan view and of a view in elevation of an experimental device comprising hoops on a shaft and also a comb, the shaft rotating in a certain direction.

In FIG. 10, the shaft 100 rotates in the direction shown by the arrow 104, i.e. causes the upper portion of the hoops to perform a movement of which the direction is indicated by the arrow 104. In view of the friction between the hoops and the teeth 103, the shaft exerts on each hoop, at its point of contact with the latter, a force represented by a vector such as that marked 106. Thus, if a hoop such as 101 commences a movement such as to assume an oblique position in respective of the axis of the shaft, a component 107 of the force 106 will oppose the obliquity and restore the hoop to a normal position, corresponding to stable equilibrium.

Figure 11:
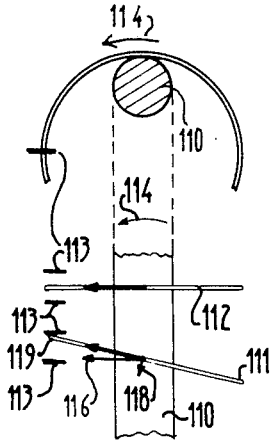
FIG. 11 is a corresponding diagram showing the shaft rotating in the other direction.

In FIG. 11 shaft 110 rotates in the opposite direction (arrow 114) to the shaft 100 of FIG. 10, and if a hoop 111 commences a movement in which it assumes an oblique position in respect of the axis of the shaft 110, this oblique position can only be accentuated under the effect of the component 118 of a force 116, since this component takes the same direction as the said oblique position. In other words, a normal position such as that occupied by the hoop 112 is a position of unstable equilibrium. It would even be possible, from a certain angle of inclination on the shaft onwards, for an edge 119 of the hoop to come out of the teeth 113.

Figure 12:
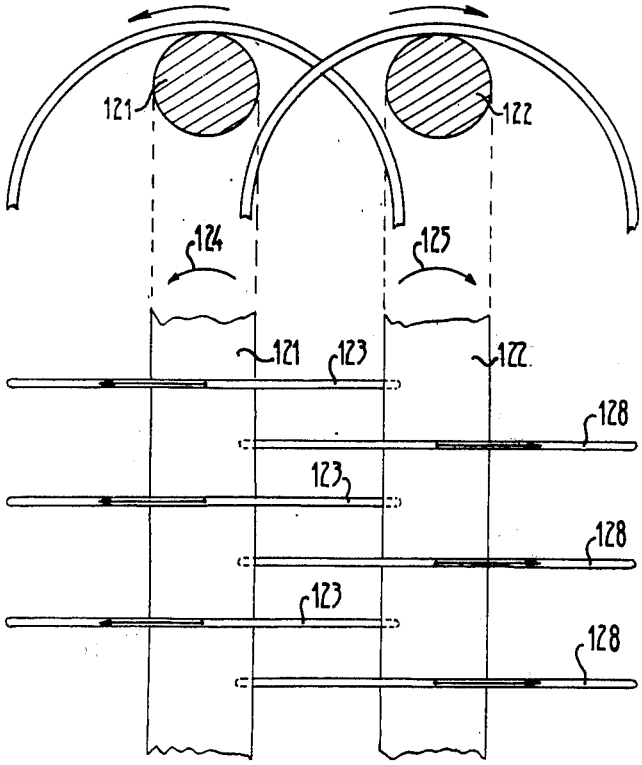
FIG. 12 is a combination of a plan view and of a view in elevation, of an experimental device comprising two shafts supporting intercalated hoops.

In FIG. 12 hoops are mounted alternately on shafts 121 and 122, the hoops 123 of one and the same shaft forming a comb for the hoops 128 of the other shaft, and vice versa, and if the shafts rotate in the directions shown by the arrows 124 and 125, i.e. the right shaft rotates clockwise and the left shaft rotates anticlockwise, the conditions of FIG. 10 are present, thus creating the automatic guiding phenomenon aforesaid wherein as previously explained, the hoops of each shaft interact with those of the other shaft.

Referring now to FIGS. 1, 2 and 3, 1 is a treatment tank or chamber containing a treatment liquid shown at 11 in FIG. 2.

Above this tank are two driving shafts 4 and 5, supported and rotated in the direction shown by the arrows 41 and 51 (FIG. 2) by a motion-reversing device 44 driven by a motor 55. (See FIG. 3.) The shafts 4 and 5 serve to support and drive helices 2 and 3 respectively, consisting of wire to be treated by passing through the treatment bath 11, such as a pickling bath. As may be seen from FIG. 3, the turns of the helices interpenetrate in the median region, this arrangement being likewise known in itself; to enable the arrangement of the helices to be understood more clearly, the length of their turns in FIG. 3 has been intentionally exaggerated.

Figure 9:
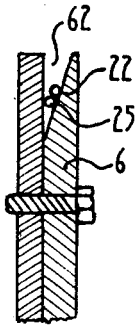
FIG. 9 is a sectional diagram, on a larger scale, of a part of a capstan for forming a helix.

As regards the helix 2, this is formed from its entering strand 21 in the following manner: the strand 21 passes over a V-grooved capstan or winch 6 driven in the direction shown by the arrow 61 (FIG. 1). This capstan 6 is partly shown in section in FIG. 9, enabling its V-groove 62 to be seen; the strand 21, passing over the capstan, forms a half turn 22 and then leaves the capstan in a straight line at 23 in order to pass over an idle satellite or roller 8, returning to the capstan 6 in a straight run 24 which crosses the strand 23, passing in front of it, and which, in the V-groove 62, forms a half turn 25 underneath the half turn 22, (FIG. 9) thus providing the commencement of the helix 2.

The formation of a helix by a grooved capstan and an associated roller is a system already known in itself. The advantage of a device of this kind is that the emerging turn 26 is larger than the half turn 25 on the capstan. The crossing of the strands between the capstan and the satellite has the effect of increasing the development of the turn 26.

As regards the helix 3, this is formed from its entering strand 31, by means of a capstan 7 driven in the direction shown by the arrow 71 (i.e. in the opposite direction to the capstan 6), and an idle roller 9 associated with the said capstan 7; a turn 36 is thus formed and provides the commencement of the helix 3.

Means known per se 60 and 70 are provided to rotate capstans 6 and 7 in opposite directions. These means may be seen on FIG. 8.

The capstans 6 and 7 are slightly offset longitudinally, as may be seen from FIG. 3, in which this offset, moreover, is to some extent exaggerated; it can nevertheless be said that the capstans thus arranged are substantially coplanar. The actual offset is equal to the thickness of the wire being treated. In FIG. 1 it may be seen that the turn 36 passes in front of the turn 26.

Having thus been formed on the capstans 6 and 7, the helices 2 and 3 are supported and driven by shafts 4 and 5; owing to the fact tha their turns increase in size on emerging from the capstan, the turns of the helices overlap.

The distance between the shafts 4 and 5 is such that in view of their diameter each helix does not touch the shaft supporting the other helix when all the turns of these helices are of normal size, as may be seen from FIG. 2 or, on a larger scale, from FIG. 4. If for some reason a turn 37 (FIG. 4) of the helix 3 becomes larger than normal, it will contact the shaft 4 (FIG. 5). At this moment, that part of the turn 36 which is situated between the two shafts 4 and 5 is driven by the said two shafts simultaneously. There is always a slight slip between the helix and the shaft; the driving action is more efficient with two shafts than with only one, in addition to which the turn of the helix is gripped between the two shafts by reason of their combined action, rendering the driving still more efficient.

The slip is thus reduced, which suffices to cause the head of the turn 37 to move at a slightly higher speed than the tail of the same turn; it is reduced in size and reverts to the normal dimension. A simple calculation would show that such a regulation of the size of the turns takes place without contact of the helices with the bottom of the tank when the distance between the shafts is smaller than the square root of twice the product of the radius of the shaft into the distance from the top of said shaft to the bottom of the tank. This may be inferred from FIG. 2 where:

A and B are the axes of shafts 5 and 4
O is the center of a turn of a helix driven by shaft 4
d is the distance between the axes of the shafts 4 and 5
R is the radius of the turn of the helix
*a* is the radius of a shaft
D is the distance between the bottom of tank 1 and the top of shafts 4 and 5. Considering the triangle ABO $$d^2 = (R + a)^2 - (R - a)^2$$

resulting in:

$$d = \sqrt{4aR} \qquad (1)$$

furthermore, in order that the turn of the helix driven by shaft 4 should not come into contact with the bottom of the tank, it is necessary that $$R < D/2 \qquad (2)$$

by comparing (1) and (2), it is necessary that $$d < \sqrt{2aD}$$

In many cases, instead of being supported by one single shaft, each helix is supported by two shafts; the two shafts supporting a helix will naturally rotate in the same direction, but in accordance with the present invention the pair of shafts supporting one helix will rotate in the opposite direction to the pair of shafts supporting the other.

Figure 6:
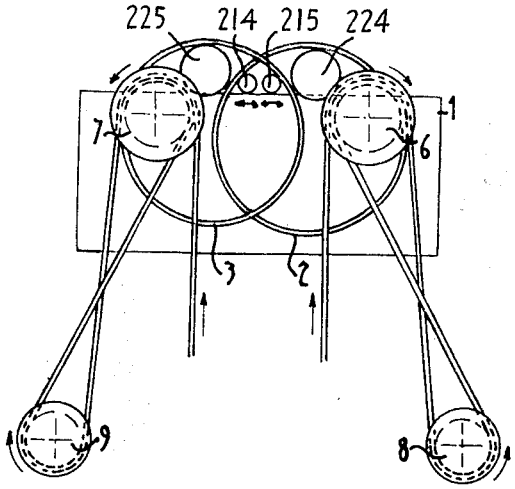
FIG. 6 is an end view of a device in accordance with a second embodiment of the invention, with two helices, each of which is supported by a respective pair of shafts.
Figure 7:
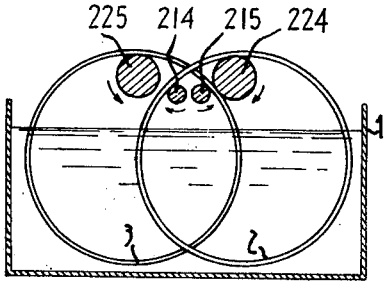
FIG. 7 is a transverse sectional view of the same.
Figure 8:
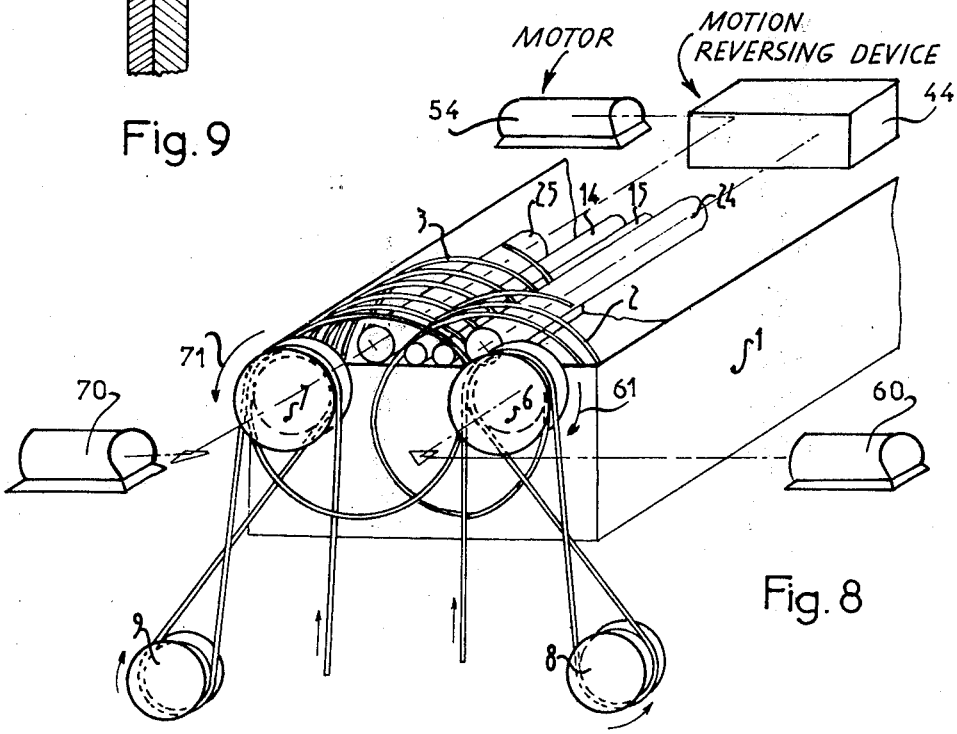
FIG. 8 is a view of the same in perspective.

This may be seen from FIGS. 6, 7 and 8, in which the helix 2 is supported and driven by a pair of shafts, a main or outer shaft 224 and a secondary or internal shaft 214 and the helix 3 is supported and driven by another pair of shafts, a main or outer shaft 225 and a secondary or internal shaft 215. It may be seen from FIG. 7 that the helix 2 passes in the vicinity of the main shaft 225, which in relation to this helix performs the same function as the shaft 5 in FIG. 2. As regards that turn of the helix 3 which may be seen from FIG. 7, it is in contact with the main shaft 224, because it is assumed to be larger than normal; the shaft 224 of FIG. 7 performs the same function as the shaft 4 of FIGS. 2, 4 and 5; generally speaking, when two helices are each supported by a pair of shafts the main or outer shaft of each pair regulates the helix of the other pair.

Secondary or internal shafts 214 and 215 may be seen from the same diagrams, i.e. FIGS. 6, 7 and 8; their diameter is smaller than that of the main or outer shafts and they cross over, as previously explained. Means known in themselves are provided for the independent adjustment, during operation, of the distance of their respective axes from the median plane of the treatment bath and thus to enable the turns to be adjusted to a greater or smaller extent by temporary contact with the main shaft of the other helix. Said means are not shown in the drawing.

In FIGS. 6, 7 and 8 the formation of the helices 2 and 3 is effected by the capstans 6 and 7 and by the rollers 8 and 9, as explained previously.

An improved apparatus according to the invention, to enable a material in wire form, shaped in two interpenetrating helices, to be treated in a bath, therefore enables the turns of the helices to be automatically guided and automatically regulated simultaneously, its advantages by comparison with the apparatus already known residing in the greater simplicity and greater flexibility of operation, due to the possibility of selecting the right number of turns to enable the treatment to be adapted to each particular type of material to be processed.

The foregoing description of preferred constructional versions, given by way of an example, does not restrict the scope of the invention, which is only limited by the claims which now follow.

I claim:

1. In apparatus for treating flexible resilient filamentary material of indefinite length, a tank having a longitudinal horizontal axis extending from an entrance end to an exit end thereof, first and second shafts journaled over said tank for rotation about respective first and second axes spaced horizontally a predetermined distance and parallel with said longitudinal axis, first means guiding a first strand of material into said tank at the entrance end thereof to form a first helix comprising a multiplicity of axially-spaced loops each in contact with and supported by said first shaft with each loop passing adjacent and slightly spaced from said second shaft, second means guiding a second strand of material into said tank at the entrance end thereof to form a second helix comprising a multiplicity of axially-spaced loops each in contact with and supported by said second shaft with each loop passing adjacent and slightly spaced from said first shaft, each loop of each helix extending downwardly into said tank and intercalated between a consecutive pair of loops of the other helix, power means connected with said shafts and rotating the same in opposite directions, and means guiding in succession the loops of both helices out of said tank at the exit end thereof.

2. The apparatus of claim 1, said power means rotating said first shaft counterclockwise and said second shaft clockwise, said shafts being left and right respectively, as viewed therealong from entrance end to exit end of said tank.

3. The apparatus of claim 2, the parallel axes of said first and second shafts being spaced apart a distance $d = \sqrt{4aR}$, where "$a$" is the radius of each shaft and "R" is the radius of each said helix when each loop thereof is slightly spaced from the shaft supporting the other helix, as aforesaid.

4. The apparatus of claim 3, the dimensions being such that $d < \sqrt{2aD}$, where "D" is the vertical distance between a plane over and tangent to said shafts and the bottom surface of said tank.

5. The apparatus of claim 2, and third and fourth shafts journaled over said tank for rotation on third and fourth axes parallel with said first and second axes, said third and fourth shafts being equally spaced on opposite sides of a vertical median plane parallel with and midway between said first and second shafts, and disposed in the space defined by and between the intercalated portions of the loops of said helices, said third shaft being adjacent said second shaft and contacting and assisting in support of the loops of said first helix, said fourth shaft being adjacent said first shaft and contacting and assisting in support of the loops of said second helix.

6. The apparatus of claim 5, said third and fourth shafts being idlers and having their spacing adjustable equally and oppositely toward and from said median plane to thereby vary the radii of said helices.

7. The apparatus of claim 2, said first and second means comprising, respectively, first and second capstans each having a V-groove in its circumference and each journaled at the entrance end of said tank adjacent a respective one of said first and second shafts, and first and second idler pulleys each adjacent a respective one of said capstans, all said shafts, capstans and pulleys being rotatable on parallel axes, said first and second strands extending in a first pass of about 180° around said first and second capstans respectively, thence in a straight run to and about a respective one of said first and second idler pulleys, thence in a straight run back to and about the corresponding capstan in a second pass externally of and circumferentially contacting its first pass, thence in helical form into said tank to and over a respective one of said first and second shafts, as aforesaid.

8. The apparatus of claim 7, said capstans being offset axially along their axes of rotation by a distance equal to the thickness of the strands.

9. The method of continuously treating flexible resilient strand material of indefinite length, comprising, supporting on respective rotatable parallel first and second shafts horizontally spaced a predetermined distance and above a tank adapted to contain treatment fluid, first and second helices of said material with each loop of each helix extending into the tank and intercalated between a consecutive pair of loops of the other helix in the space between said shafts, each loop of each helix being normally spaced a short distance from the shaft supporting the other helix, and rotating said shafts at synchronous speeds and in opposite directions, whereby enlargement in diametral size of any loop of either helix results in contact of the enlarged loop with the shaft supporting the other helix to thus instantaneously augment the linear speed of the loop and correspondingly reduce the enlargement.

10. The method of claim 9, and continuously supplying at a predetermined rate, two strands of material to an entrance end of said tank, forming said strands into additional loops of the helices, and withdrawing treated loops of material from the helices at the exit end of the tank and at essentially the same rate.

* * * * *